US009909239B2

(12) United States Patent
Karatzis

(10) Patent No.: US 9,909,239 B2
(45) Date of Patent: Mar. 6, 2018

(54) METHOD FOR PRODUCING A NET WITH ELONGATED STITCHES

(75) Inventor: Antonios Karatzis, Crete (GR)

(73) Assignee: Karatzis S.A., Heraclion (GR)

( * ) Notice: Subject to any disclaimer, the term of this patent is extended or adjusted under 35 U.S.C. 154(b) by 1042 days.

(21) Appl. No.: 14/002,584

(22) PCT Filed: Dec. 1, 2011

(86) PCT No.: PCT/EP2011/006032
§ 371 (c)(1),
(2), (4) Date: Nov. 11, 2013

(87) PCT Pub. No.: WO2012/119624
PCT Pub. Date: Sep. 13, 2012

(65) Prior Publication Data

US 2014/0060119 A1 Mar. 6, 2014

(30) Foreign Application Priority Data

Mar. 10, 2011 (GR) ..... 20110100151

(51) Int. Cl.
*D04B 21/10* (2006.01)
*D04B 27/06* (2006.01)
*D04B 23/22* (2006.01)

(52) U.S. Cl.
CPC ..... *D04B 21/10* (2013.01); *D04B 23/22* (2013.01); *D04B 27/06* (2013.01); *D10B 2505/10* (2013.01)

(58) Field of Classification Search
CPC ..... D04B 21/10; D04B 23/22; D04B 27/06
See application file for complete search history.

(56) References Cited

U.S. PATENT DOCUMENTS 3,013,419 A * 12/1961 MacCaffray, Jr. ..... D04B 23/08 66/85 R
3,428,007 A * 2/1969 Ridyard ..... D05C 15/22 112/410

(Continued)

FOREIGN PATENT DOCUMENTS

DE 6936578 U 1/1970
DE 2330961 A1 1/1975

(Continued)

OTHER PUBLICATIONS

"Sonderdruck", Special print from 2007 of the machine manufacturer Karl Mayer Textilmaschinenfabrik GmbH, pp. 4-19.

(Continued)

*Primary Examiner* — Danny Worrell
(74) *Attorney, Agent, or Firm* — Murphy, Bilak & Homiller, PLLC

(57) ABSTRACT

A method, an elongating device, a Raschel knitting machine comprising the elongating device for producing nets with elongated stitches and a net comprising elongated stitches is described. The method comprises the steps of continuously generating new loops for elongating the two rows of loops by additional loops and dragging the rows of loops in a machine direction, generating a first stitch of the weft by joining the weft to a loop of the first row and to a loop of the second row, and positioning the first stitch across a surface of an elongating device for preventing the first stitch from traveling with the warps knitted to loops in the machine direction. The joining is configured for elongating the first stitch by pulling additional weft material, and the surface of the elongating device is carrying out a reciprocating movement towards the first stitch. Further, an elongating device for elongating of the stitches is described.

7 Claims, 9 Drawing Sheets

(56) References Cited

U.S. PATENT DOCUMENTS

| | | | | |
|---|---|---|---|---|
| 3,646,782 | A * | 3/1972 | Kohl | D04B 23/08 66/87 |
| 4,417,456 | A * | 11/1983 | Bergmann | D04B 27/32 327/440 |
| 4,823,563 | A | 4/1989 | Wunner | |
| 5,104,714 | A * | 4/1992 | Leiber | D01D 5/426 206/442 |
| 5,660,062 | A | 8/1997 | Diestel et al. | |
| 6,521,551 | B1 | 2/2003 | Mass et al. | |
| 7,188,494 | B2 * | 3/2007 | Dort | D04B 21/12 66/195 |

FOREIGN PATENT DOCUMENTS

| | | | |
|---|---|---|---|
| DE | 3630821 | C1 | 6/1993 |
| DE | 4301232 | A1 | 7/1994 |
| DE | 4301242 | A1 | 7/1994 |
| EP | 0919655 | A2 | 6/1999 |
| EP | 0919655 | B1 | 8/2003 |
| GB | 1473538 | A | 5/1977 |
| JP | S488708 | U | 1/1973 |
| JP | 4844999 | B1 | 12/1973 |
| JP | 5054635 | A | 5/1975 |
| JP | S52110974 | A | 9/1977 |
| JP | 03274392 | A | 12/1991 |
| JP | 08510793 | A | 11/1996 |
| JP | H1175580 | A | 3/1999 |
| JP | 11315453 | A | 11/1999 |
| JP | 2003129360 | A | 5/2003 |
| JP | 2006176900 | A | 7/2006 |
| JP | 2006176908 | A | 7/2006 |
| JP | 2007082866 | A | 4/2007 |
| RU | 374848 | | 3/1973 |
| WO | 9417232 | A1 | 8/1994 |

OTHER PUBLICATIONS

"Warp Knitting for the manufacture of netting for various applications", Karl Mayer Textilmaschinenfabrik GmbH, 1994.

Arnold, Rolf et al., "Herstellen von Verpackungsmitteln nach der Kettenwirktechnik", Technische Textilien, vol. 20, 2/3, 1977, pp. 68-75.

Arnold, Rolf et al., "Verarbeitung monoaxial gereckter Folien auf Kettenwirkmaschinen", Textiltechnik, vol. 26, Heft 1, 1976, pp. 45-50.

Huschka, Rudolf et al., "Herstellung and Eigenschaften von Textilien aus Foliefaeden", Deutsche Textiltechnik 18, Hefte 3/4, 1968, pp. 137-141, 210-216.

Raz, S., "Warp Knitting Production", Melliand Textilberichte GmbH, Heidelberg, 1987, pp. 174-177, 216-217, 394-395.

Schinkoreit, Wolfgang, "Wirktechniken durch Fadenreservebildung in Schussrichtung", Melliand Textilberichte—International Textile Reports—German Edition, Dec. 1995, p. 1090.

* cited by examiner

State of the Art

METHOD FOR PRODUCING A NET WITH ELONGATED STITCHES

The present application refers to a method, an elongating device, and a Raschel knitting machine comprising the elongating device for producing nets with elongated stitches and a net comprising elongated stitches.

It is well known to use Raschel knitting machines for the production of nets. Such Raschel knitting machines are for example sold by Karl Mayer Textilmaschinenfabrik GmbH, Frankfurt, Germany.

Before describing how a conventional net is produced using a Raschel knitting machine the terminology used in this application is described. To illustrate the elements of the net it is referred to FIG. 1 illustrating a conventional net. The same terminology is used for a net according to the invention. The reference signs used for a conventional net carry the mark "'". The same numbers without the mark "'" are used for the corresponding parts of the net according to the invention:

Net 1': The net 1' is made up by a plurality of warps 2' that are knitted into rows of loops and of wefts that join the warps 2'.

Thread: The warps 2' and the wefts 3' are formed by threads.

Warp 2': The threads that are knitted to loops. A plurality of warps 2' may be knitted to a plurality of rows of loops. In a standard Raschel knitting machine the warps 2' are positioned along a flow direction of the net.

Weft 3': The threads that from stitches 4' that join the warps 2' to a net 1'. The weft 3' is not joined firmly by for example a knot to the warp 2'. The wefts 3' may be for example guided through or around the loops of the warps 2'.

Stitch 4': The portion of a weft 3' that is positioned in-between two joining points 5' of the weft 3' with two warps 2', i.e. the stitch 4' is the portion of the weft 3' making up a connection between two warps 2'.

MD (machine direction) 7: The flow direction of the net 1' during the production of the net 1'.

TD (transversal direction) 8: The direction vertical to the flow of the net 1' and parallel to a plane formed by the net P.

Hole needles: Needles with holes to guide the threads. Specifically there are hole needles for guiding the warps 2' and different hole needles for guiding the wefts 3'.

Needles: The needles are used to form together with the hole needles for the warps 2' the loops of the warps 2'. During the production of the net 1' the needles execute normally a linear reciprocating motion (normally up and down). In a Raschel machine a plurality of needles may be placed over a needle bar as a guide bar and by moving the needle bar the needles are moved together.

Comb One: A first guide bar for moving the hole needles which guide the warps 2' thereby moving a hole needle for the warps 2' around a needle, for example in a rotational way.

Comb Two: A second guide bar to which the hole needles that guide the threads of the wefts 3' are attached. Normally the second guide bar is moved so that the hole needle for the weft 3' is executing a linear reciprocating movement from one needle to another needle and in this way creating the stitches 4' of the wefts 3'.

Stitch Comb Bar: A reciprocating move base equipped with stitch comb guides to help warps keep their position during the process.

For illustrating an objective of the present application a specific zig-zag stitch pattern is used for illustration reasons only as shown in FIG. 1. However, the present invention is not restricted to this specific zig-zag stitch pattern.

As shown in FIG. 1, the warps 2' are forming rows of loops. The wefts 3' join the warps 2' and, thereby, a net 1' is generated.

The joining points 5' of the warps 2' with the wefts 3' may be positioned equidistant, for example every four loops, and two zig-zag stitches 4' form an isosceles triangle with the warp 2' as a basis.

During the production of the net the rows of loops are substantially linearly arranged and the distance of the rows of loops formed by the warps 2' are determined by the distance of the needles. The zig-zag stitches 4' are stretched, thus the length of the zig-zag stitches 4' corresponds to the shortest distance between the joining points 5'.

Accordingly, the length of the zig-zag stitch 4' may be calculated according to the Pythagorean theorem. For example if it is assumed that the length of the four loops is equal 42 mm and a distance of the warps 2' is 25.4 mm, a length of 32.95 mm is obtained for the zig-zag stitch 4'.

It is noted, that in similar way the calculation of a theoretical length may be calculated for every stitch pattern.

During the production of a net the warps and wefts are under tension and, therefore, in a conventional Raschel machine the length of the stitch corresponds to this theoretical length. Such nets may not or at least not considerably be stretched in any direction without changing the dimension in a direction perpendicular to the stretching direction. Further, for producing extra wide nets additional rows of loops of warps have to be added. The addition of warps requires a large effort and, further, is limited by the width of the production machine, i.e. the Raschel knitting machine.

EP 0919655 B1 describes a method for generating elongated stitches (schuss) using a trick plate with corrugations perpendicular to a movement direction and carrying the needles for forming the loops. When a net is dragged over such a trick plate, the stitches are forced to move over the tops of the corrugations. Thus, the stitches exiting the trick plate are longer than the ones entering the trick plate.

However, the corrugations form a massive barrier for the stitches when traveling over the trick plate, thereby exercising a high force on the weft. This force is increasing with a height of the corrugations. Since an elongating factor, which is the factor by which the calculated length has to be multiplied to obtain the elongated stitch length (expressed for example as 1.5 or 150%) is determined by the height of the corrugations the achievable elongating factor is limited by the stability of the material that is used for the weft. Further, the stitch material experiences a high friction during the movement over the trick plate. This increases the risk of breaking of the material of the stitch.

It is the objective of the present invention to provide a method for generating a net having elongated stitches with a very high elongating factor, devices to produce such nets having elongated stitches and the net having elongated stitches with a reduced risk of breaking of the material.

This is achieved by the subject matter according the independent claims. The dependent claims refer to further embodiments.

An elongating device according to the present invention for elongating the length of a stitch may be used in a Raschel knitting machine. The elongating device is elongating the length of a stitch made of a weft joining two rows of loops of warps during manufacturing of a net in a Raschel knitting machine by controlling the traveling of the stitch during dragging of the rows of loops.

The elongating device comprises an object that is oblong and flexible with a surface for positioning the stitch during dragging of the rows of loops and with an abutment portion for pressing against an abutment element during a reciprocating motion of the object, and comprises an attachment means for attaching a driving means for causing the reciprocating motion. The elongating device is configured for moving the surface of the object towards the stitch during the reciprocating motion.

The expression "during" has the meaning of "at least during a part" of the respective time or motion. Thus, the expression "during" includes both cases of "permanently during" and of "only for parts of the time during" in this application and when the expression "during" is used both cases may be realized. Further, positioning of the stitch on a surface has the meaning that at least a part of the stitch is positioned on the surface. The stitch may be positioned so that the stitch is crossing the surface.

The rows of loops are knitted and during knitting the loops the net travels in the machine direction. Thus, continuously new loops are generated and the rows are lengthened. The rows are connected by a stitch that may be joined to the warp in the process of creating a loop. During dragging the rows of loops as well the wefts may be dragged, i.e. the wefts and the warps may be fixed to a dragging means pulling the net. Without the elongating device the stitch would travel together with the rows of loops in the machine direction. The elongating device may block the way of the stitch in that the stitch is positioned on the surface of the object, for example by crossing the surface. When the rows are further dragged in the machine direction the joining points which may be a loop to which the stitch is joined may travel with the net. Since the stitch may still be positioned on the surface, further material of the weft may be pulled to form an elongated stitch.

The elongating device is configured to carry out the reciprocating motion and a stitch may be positioned on the surface of the object during the reciprocating motion. During one half cycle of reciprocating motion the surface of the object may be moved in the direction of that part of the stitch that is positioned on the surface, thereby the surface may exercise a force on the stitch. When the movement of the surface is directed in the opposite direction, the force exercised by the surface on the stitch is reduced.

The object may be elastic and the object may be bent. The bent form of the object in the relaxed state may comprise one part that is having approximately a rounded form for allowing a flexible and/or elastic bending. The rounded form may be formed by a plurality of angled straight parts. Further, the object may comprise a first straight part with the surface for positioning the stitch extending tangential from one end of the rounded form and a second straight part as the abutment portion, configured to press against the abutment element being arranged at the other end of the rounded form in a direction away from the rounded form on a line intersecting the rounded form.

The reciprocating motion and the pressing of the elongating device against the abutment element may cause a vibration-like motion of the elongating device. This vibration-like motion may be supported by the flexibility and/or elasticity of the object. This vibration-like motion may reduce the friction of the stitch on the surface.

The reciprocating motion may be carried out at any machine operating frequency, for example with a frequency of 200 cycles/min or more, 500 cycles/min or more, or 1000 cycles/min or more.

Further, the reciprocating motion may support the elongating of the stitch actively by exercising with the surface a force on the stitch opposite to the traveling direction during a period of the reciprocating motion in which the surface moves towards the stitch.

During the reciprocating motion the surface may follow a bow-like path. The bow-like path may be a movement having two perpendicular components parallel to a plane formed by the bent and oblong object. The bow-like path may be a path on a part of the circumference of an ellipsoid, oval or circle. A horizontal component of the bow-like path may be in a range of 1.5 mm to 20 mm or may be in the range of 4 mm to 18 mm.

When following the bow like path the surface of the object on which the stitch is positioned may be inclined and the stitch being kept under tension on the surface may move along the surface according to the inclination change. The reciprocating motion may further support the movement along the surface by reducing the friction.

The elongating factor may be controlled by the length of the bow-like path. The elongating factor may be controlled by controlling the length of time the stitch is positioned on the surface.

A projection may be provided on the surface of the object of the elongating device. This projection may be configured for preventing a stitch positioned on the surface from moving off the surface during the reciprocating motion and the dragging of the rows of loops.

The projection may be positioned on the surface in an area to which the stitch is moving from an initial position for example by the dragging force acting on the net in the machine direction. The projection may be formed so that the stitch is released at an end of the bow-like path or on the bow like path. The projection may be formed by a piece of material extending from the surface and the angel under which the projection is sticking out of the surface may be such that the surface is inclined by the reciprocating motion at least by that angle. For example, if the surface is horizontally positioned in a first position of the reciprocating motion, the object may be inclined by the reciprocating motion so that now the projection is horizontally positioned. Thus, the reciprocating motion may facilitate the release of the stitch off the surface over the projection.

The projection may be flexible or elastic for releasing the stitch acting on the projection. The stitch acting on the projection may be dragged due to the dragging force acting on the rows of loops and may exercise a force on the projection. The force may be large enough for pressing down the projection and the stitch may be released.

The projection may have such a flexibility or elasticity that the force of only one stitch acting on the projection is not large enough, but only when two, three or more stitches act on the projection, the stitch that has been positioned first on the surface may be released. The projection may be configured to release the first stitch in a row of a subsequently added stitches acting on the projection according to a predetermined number of stitches acting on the projection. The predetermined number may depend on factors that may be controlled without changing the elongating device itself, for example the dragging speed of the rows of loops, the material of the wefts, the path of the reciprocating motion.

The release by the reciprocating motion due to the inclination of the projection and the flexibility or elasticity may be combined such that the necessary inclination angle for releasing is reduced by the flexibility and/or elasticity of the projection.

The material of the projection may be a metal or a synthetic material. The projection may be a spring element.

The projection may be punched out from the surface of the object. Further, the projection may have a form of a nub, a stud, a lug, a flap or a lip.

The projection may be formed integrally with the surface of the object or may be removably attached to the surface.

The object may be a stripe of material or a may have a rounded cross section. The object may be a rod of material. The rod may be a pipe. The stripe of material may be a band or a plate having a form of for example a lamellar, a blade or a vane. The object may be made of a sheet metal. The oblong object may have rounded edges or bent edges for avoiding hurting of the stitch.

The object may be bent by one or more angles between straight areas. The object, e.g. the stripe of material or the pipe of material, may be angled or may have a bent shape without angles. The bent shape may be parabolic. The shape may be a combination of angled and parabolic. The elongating device may be formed by one piece of material or may be assembled by different pieces.

The length of the object is not specifically limited. The length is preferably such that a weft crosses the surface of the object when the weft is guided from one needle to another needle. The length of the object may be in the range from 10 cm to 50 cm or 10 cm to 20 cm.

The width of the object may be freely chosen. Preferably the width is selected so that the stripe of the surface on which the stitch is positioned fits in-between the needles. The width of the oblong object may be in the range of 1.5 mm to 20 mm.

The thickness of object may as well be freely chosen. In the case that the material of the oblong object is a metal preferably the thickness of the oblong object is in the range between 0.1 mm to 2.5 mm. In case that a synthetic material is used for the object the thickness of the object is preferably in the range from 1.5 mm to 3.5 mm.

The material of the object may comprise a metal, for example steel or spring steel, or a synthetic material or a ceramic element or a combination of at least two of a metal, a synthetic material or a ceramic element or a combination of a metal, a synthetic material or a ceramic element.

The surface on which the stitch may be positioned during dragging may be a flat surface and, further, may be shorter in the direction in which the stitch is crossing the surface than in the direction perpendicular to the direction in which the stitch is crossing the surface.

The attachment means may be positioned on the surface for positioning the stitch or on the first straight portion. The attachment means may be of any type of attachment means for using known attachment method configured to keep the elongating device attached to the driving means during the reciprocating motion and configured to make the object follow the reciprocating motion. The attachment means may be configured for a removable and permanent attachment. The attachment means may be a hole for a screw, a button, a clip, a latch.

The driving means may comprise a transmission element for transmitting the force of a drive to the elongating device. The transmission element may be a guide bar.

The abutment portion may be configured to be freely movable along the surface of the abutment element. The elongating device may be configured to be positioned in a Raschel machine in a bent state under stress by being fixed via the attachment means to a first element of the Raschel machine and pressing with the abutment portion to a second element of the Raschel machine. In-between these two areas, the elongating device may be contactless to the Raschel machine. This may allow a free movement during the reciprocating motion and a free vibration of the elongating device caused by the reciprocating motion and/or the flexibility of the object.

The surface for positioning the stitch during dragging of the rows of loops may be positioned at the opposite end of the oblong object than the abutment portion.

The object may further comprise a further surface for positioning the stitch. The further surface may be angled with respect to the above-identified surface for positioning the stitch. For clarity reasons as well the expression "first surface" is used for the above-identified surface. The further surface may be adjacent to the first surface. The further surface may be a further portion of the object along the bending from the first surface towards the abutment portion. The further surface may be configured for keeping the stitch positioned on the further surface under tension during production of the net.

One or more other surfaces being configured according to the further surface and positioned along the bending from the further surface towards the abutment portion may be provided, each being angled with respect to the adjacent surfaces.

As outlined above the joining of the warps and the wefts may allow a movement of one against the other with only limited retention force. Preferably an elongated stitch under tension is not suddenly released from the tension for avoiding that a consecutive stitch that is under tension may pull material from a previous stitch.

The elongating device may be configured for pulling further weft material by forming a barrier or by actively pulling by the reciprocating motion using the further surface during further dragging the rows of loops. The active pulling with the further surface according to the reciprocating motion may correspond to the active pulling by the first surface but may be directed in a different direction.

The projection may be positioned on the first surface so that after having released a stitch off the first surface the stitch is directly transferred to the further surface.

A Raschel knitting machine for producing a net with an elongated stitch made of a weft joining two rows of loops of warps may comprise a plurality of needles positioned parallel to each other and configured for carrying out a reciprocating motion for knitting the plurality of warps to a plurality of rows of loops, a plurality of hole needles positioned parallel to each other for guiding wefts from one needle to the other for forming stitches, and a plurality of elongating device as described above positioned parallel to each other. Each of the elongating devices may be positioned between two adjacent needles and below the hole needles for guiding the wefts and the elongating devices may be attached to a common guide bar coupled with the driving means for the reciprocating motion of the elongating devices. Each of the elongating devices may be attached partially to the common guide bar and abut on the abutment element and may not have any other or at least no other stiff connection to another element of the Raschel knitting machine. Thus the elongating device may be attached so that based on the reciprocating motion the elongating device is configured in its attached state to vibrate.

The reciprocating motion of the needles may be a linear motion in one direction and the needles may be joined to the needle bar and the hole needles for guiding the wefts may be configured to exercise a linear reciprocating motion perpendicular to the reciprocating motion of the needles and the hole needles may be joined to the second guide bar (Comb two).

Further, another set of a plurality of hole needles may be provided attached to a common first guide bar (Comb one) that are configured for forming the loops of warps together with the needles.

The elongating devices may be positioned only in every second space between needles or may be positioned regularly between the needles. The elongating devices may also be positioned following any pattern between the needles.

The elongating devices may be positioned over the common guide bar. The guide bar may be positioned on one side of the needles and the abutment element that may be a common abutment element for the plurality of elongating devices may be positioned on the opposite side of the needles. The elongating devices may stretch with the surface on which the stitch to be elongated is to be positioned from one side of the needles to the other sides of the needles.

The common guide bar may be the stitch comb guide bar and the elongating devices may replace the stitch comb guides. By attaching the elongating devices to a stitch comb guide or to another guide bar that is present in a conventional Raschel knitting machine, the conventional Raschel knitting machine may be modified, thereby obtaining a Raschel knitting machine according to this invention. The common guide bar may be separately attachable to the Raschel knitting machine and to the driving means. by attaching the common guide bar. By attaching a common guide bar and using the same for attaching the elongating devices a conventional Raschel knitting machine may be modified, thereby obtaining a Raschel knitting machine according to this invention. The common guide bar may be attached to a driving means already present in the conventional Raschel knitting machine or to a separate driving means.

The convex side of the bent object may be directed to a side of the Raschel knitting machine on which the net is produced and the concave side of the bent object may be directed to the opposite side of the Raschel knitting machine, wherein the bending axis is parallel to a long axis of the Raschel knitting machine.

The driving means for the elongating device may be coupled to a driving means for the needles and the hole needles for the wefts. The drive of the driving means may be a drive used in conventional Raschel knitting machine or may be a separate drive.

Further, the elongating length may be changed by moving the common guide bar for the elongating devices. The guide bar may be moved closer and/or further away from the plane in which the hole needles for the wefts are positioned. Thus a complex demounting and mounting may not be required for changing the elongating factor.

Next, a method for producing a net with an elongated stitch is described. Since the elongating device and the Raschel knitting machine comprising the elongating device that are described above may be used in a method according to the invention all method steps described above referring to the elongating device and the Raschel knitting machine may be carried out in the method according to the invention and are not repeated again below.

The method is used for producing a net with elongated stitches made of wefts, wherein the net is formed by at least two warps knitted to at least two rows of loops and by at least one weft joining the at least two warps by at least one stitch. The method comprises the steps, that may be executed at least partially in parallel, of continuously generating new loops for elongating the two rows of loops by additional loops and dragging the rows of loops in a machine direction, generating a first stitch of the weft by joining the weft to a loop of the first row and to a loop of the second row, and positioning the first stitch across a surface of an elongating device for preventing the first stitch from traveling with the warps knitted to loops in the machine direction. The joining is configured for elongating the first stitch by pulling additional weft material, and the surface of the elongating device is carrying out a reciprocating motion towards the first stitch.

Further, the elongating device may be positioned between two needles used for knitting the two rows of loops and below a hole needle for guiding the weft from one needle to the other needle, and the elongating device may be attached at one end to a guide bar for the reciprocating motion, and the elongation device may press at another end against an abutment element for a free reciprocating motion between an attachment area and an pressing area.

Further, on the surface of the elongating device, for example the surface of an oblong object, a projection may be provided for preventing the first stitch from moving off the surface, and by dragging the net, the first stitch may be moved towards the projection.

Further, during the reciprocating motion the inclination of the surface may be modified and at a specific inclination the first stitch may be released off the surface by passing over the projection.

The method may further comprise the steps of generating a predetermined number of further stitches of the weft by joining the weft to a loop of the first row and to a loop of the second row, positioning the predetermined number of stitches across the surface of the elongating device together with the first stitch and moving the predetermined number of stitches towards the projection by dragging the net along the surface. The projection may be flexible and when the predetermined number of stitches acts on the projection, the first stitch may be released.

Further, the first stitch may be positioned on a further surface of the elongating device after having left the surface, i.e. the surface the first stitch was initially positioned on, and the further surface may be angled with respect to the first surface for keeping the stitch under tension.

For clarity reasons it is repeated that the elongating device of the method may be the one described before and, therefore, all components, for example projection, abutment portion and methods described referring to the elongating device and its components may be included in the method as well.

A net according to the present invention comprises a plurality of warps forming rows of loops, and a plurality of wefts joining the rows of loops by a plurality of stitches. The length of the stitches may be more than 135% or more than 140% or more preferably more than 150% of a calculated length for a net in a non-stretched, extended state.

The not stretched extended state corresponds to a state of a net after production of the net by a standard Rachel knitting machine, i.e. the distance of the warps corresponds to the distance of the needles and the wefts that are forming straight stitches between the warps without a stretching force being applied to the net. The pattern of the stitches may be a zig-zag pattern of zig-zag stitches.

A net according to the present invention may comprise wefts with increased length of 40% (elongating factor 140%) or more or even with an increased length of 50% (elongating factor 150%) or more. The elongating factor may be 140% to 195% or larger. Preferably the elongating factor is in the range of 150% to 195%.

If the net is stretched more than 100% of the original length (elongating factor 200%), the wefts may still be loose and no the vertical forces may exist over the net. This may allow a net to be stretched in one direction without any or without any significant change of the dimension in a direction perpendicular to the stretching direction.

The net may have elasticity up to 150% (that is an elongating factor of 250% or 1:2.5) and if the net is stretched at its maximum elasticity, it may not become narrower than 10% of the original width.

A net comprising elongated stitches may be used for industrial products for example pallets.

An elastic or non elastic net comprising the elongated stitches may be used for agricultural applications for example a bale wrap, for example for hay, greens or the cultivation of tulip bulbs, which during their application grow in width in relation with their original width up to 40% (increase of a factor of 140%). For these industrial applications there exists a need for nets with the maximum width and less cost for economical reasons, i.e. there is a need for nets that allow using less material.

The wefts of the net may be elastic or non elastic threads.

The wefts may be made of elastic or non elastic polyolefins, and preferably LLDPE of Low Density Polyethylene, or LHDPE of High Density Polyethylene, as well as any other similar material.

Wefts and warps may be made of the same material.

The dimensionality of the net is not specifically limited. The net may be manufactured to almost any desired dimension depending for example on the material, the equipment, and the method that is used to produce the net.

The type of threads is not specifically limited. The threads may be thin films that have a thickness of 10 μm to 90 μm and a width from 1.0 mm to 8.0 mm before a final stretch.

It is noted that the elongating may be exercised by stretching material that is not yet fully solidified and/or by pulling further material from a material source. The material source may be a thread on a coil or an extruder newly generating the thread upon pulling the thread.

Hereinafter, the invention is described in more detail by means of the drawings wherein FIG. 1 is a schematic drawing of a net according to the state of the art;

Figure 2:
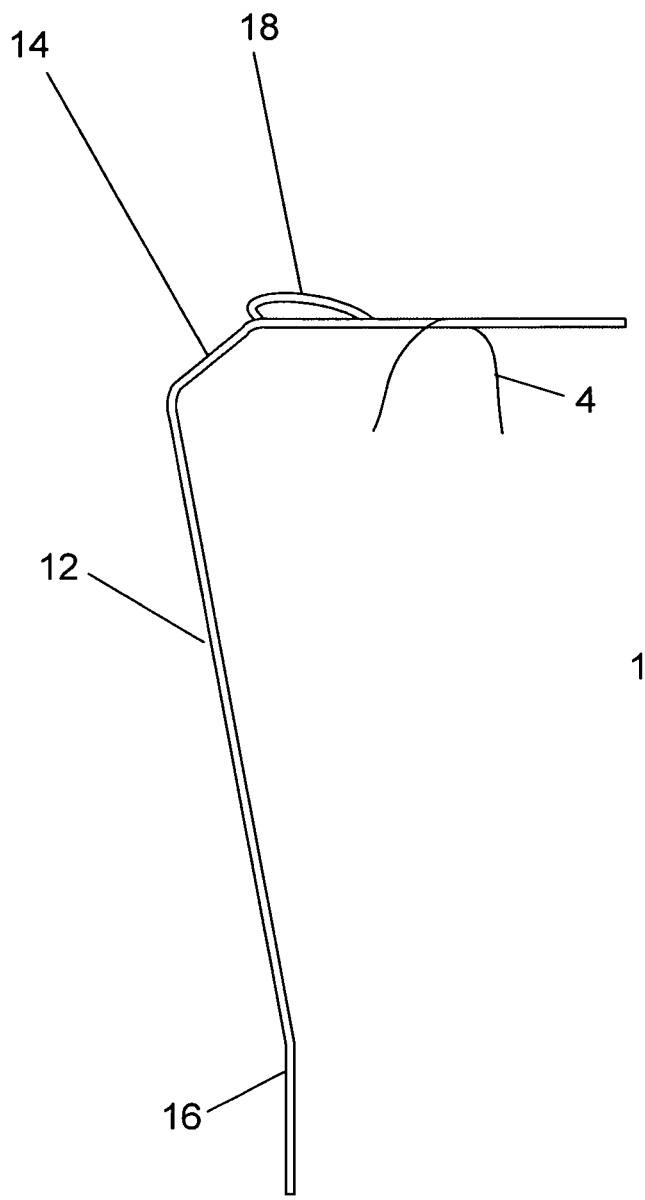
FIG. 2 is a schematic drawing of an embodiment of an elongating device according to the invention in a side view.
Figure 5A:
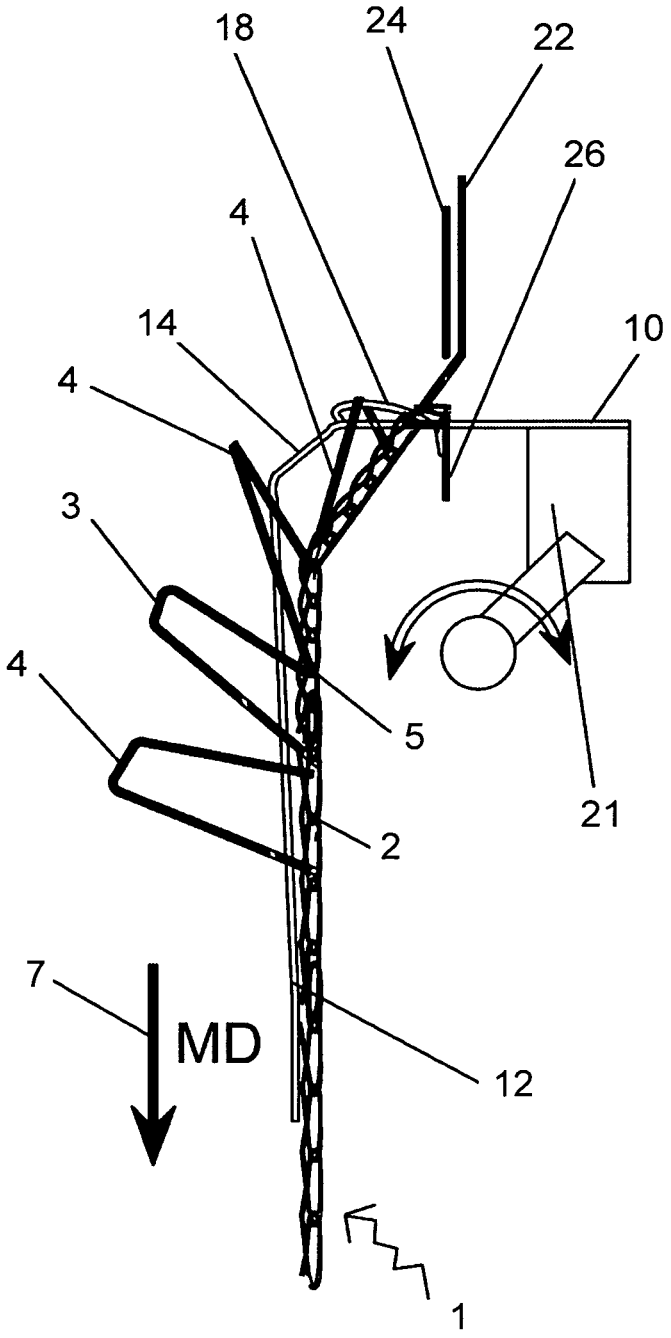
Figure 5B:
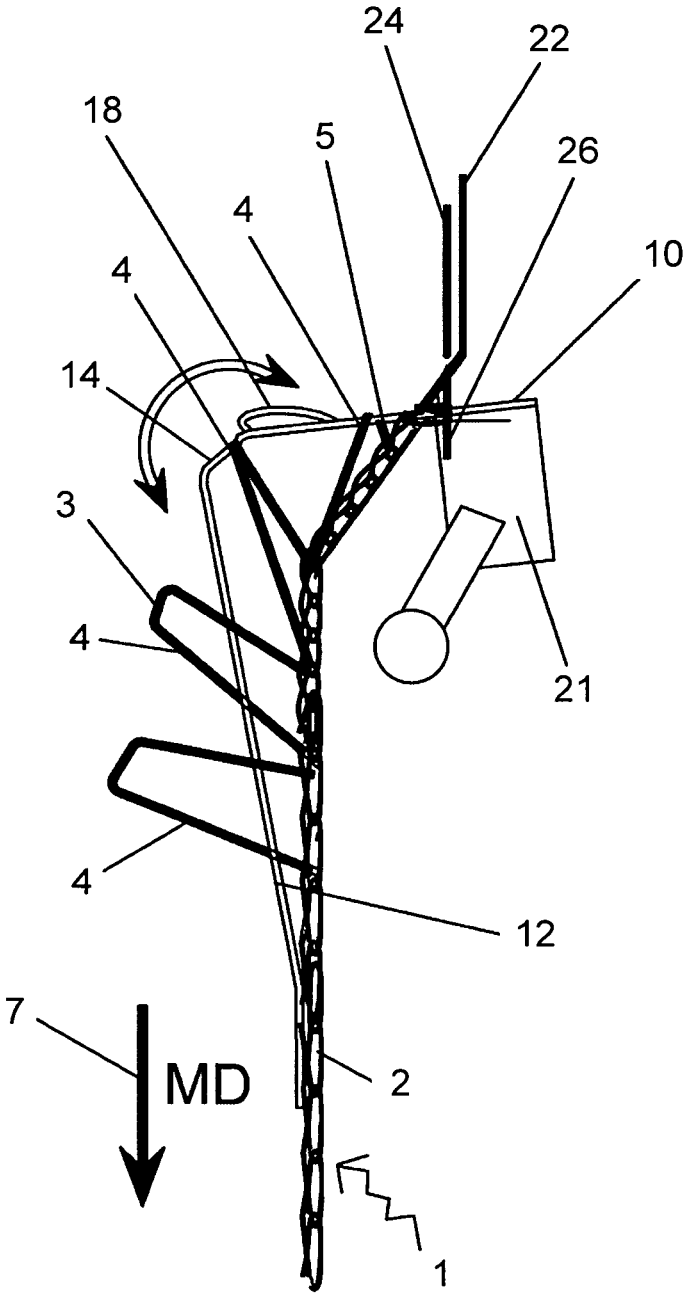
Figure 6:
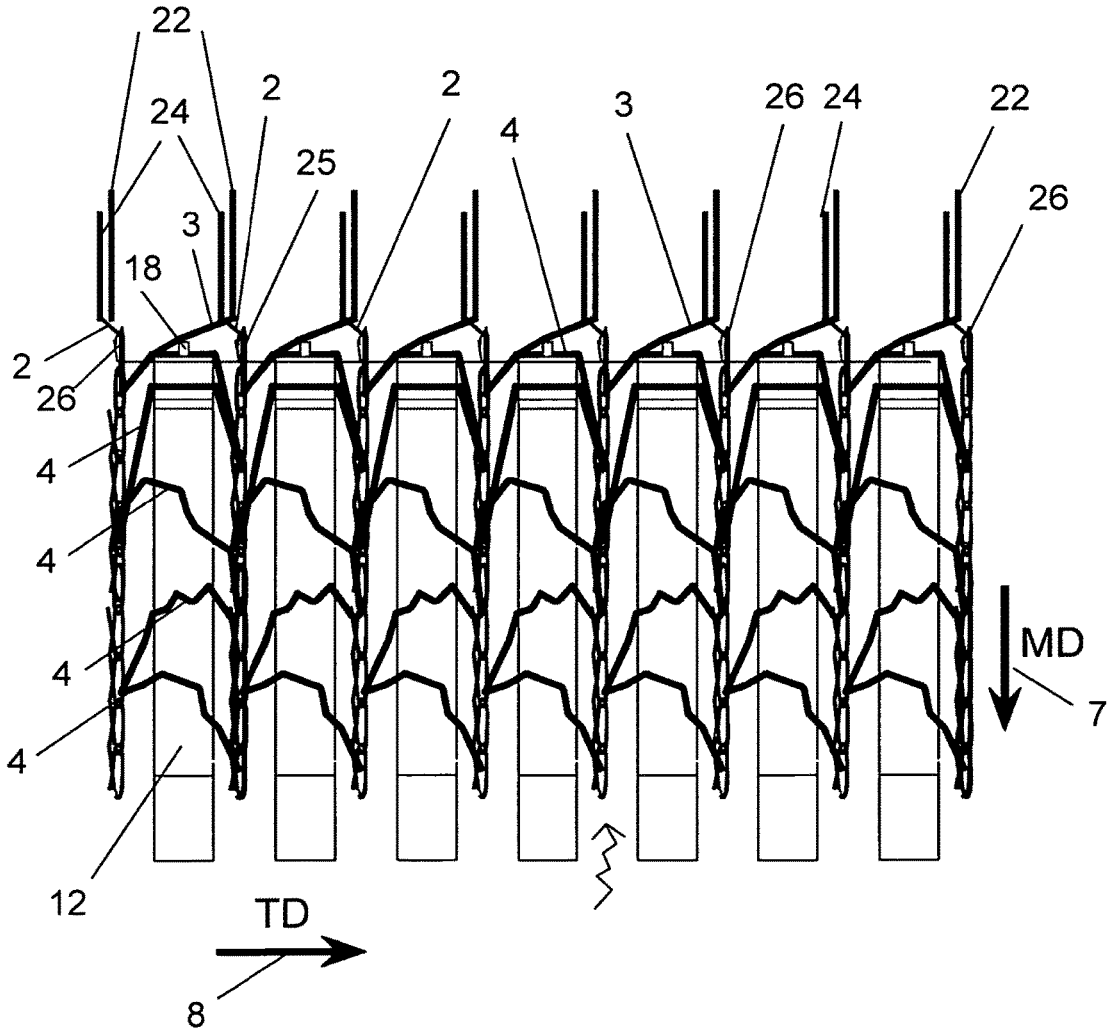
Figure 7:
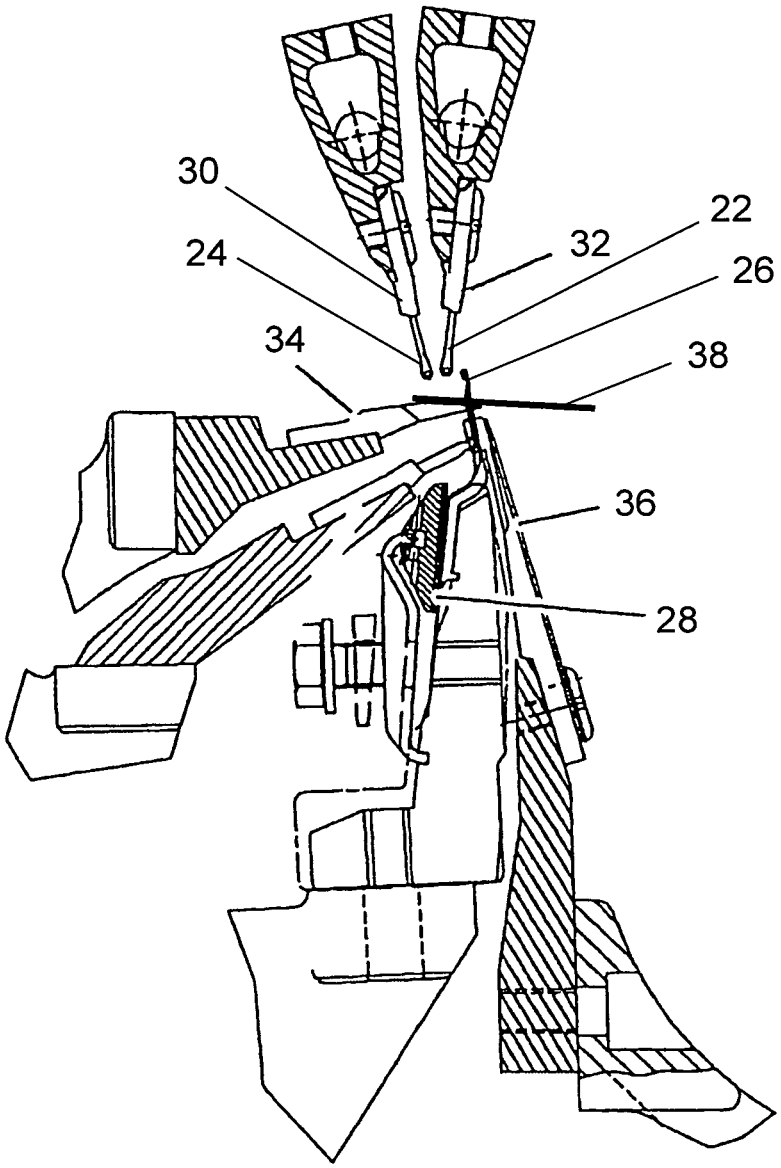
Figure 8:
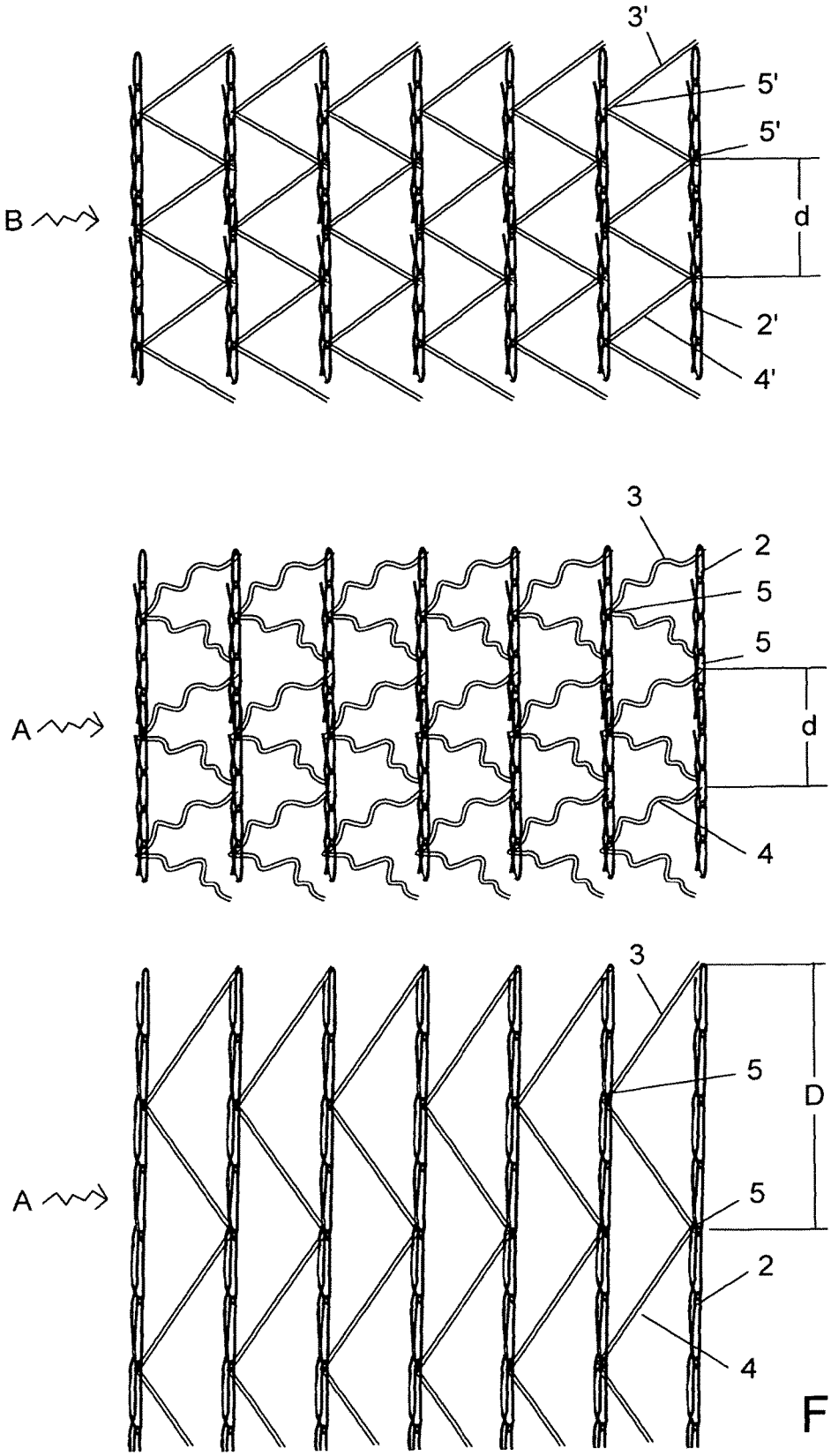
Figure 9:
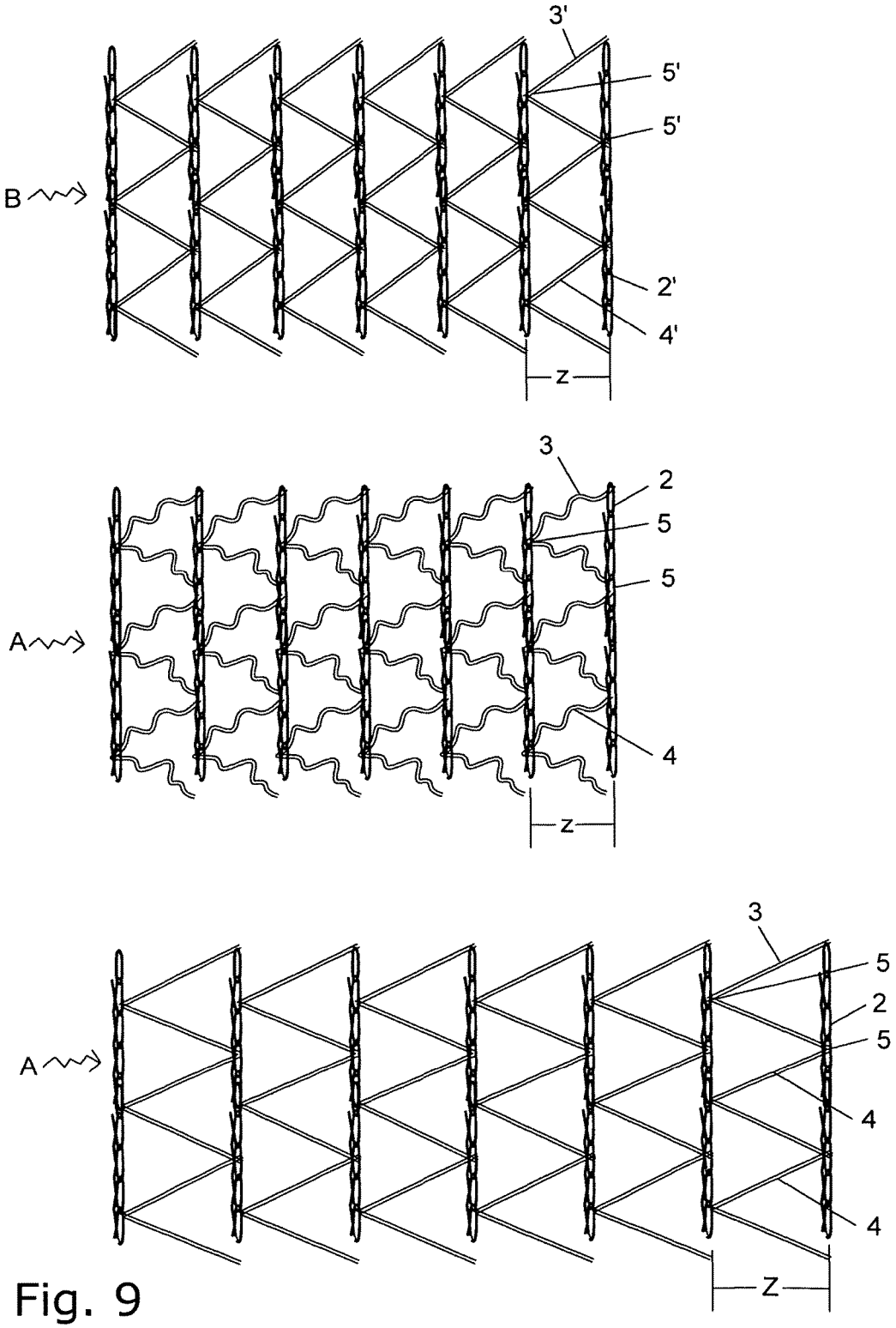

FIGS. 5*a* and 5*b* are schematic drawings of the embodiment of the elongating device of FIG. 2 in two positions during movement on a bow-like path of the reciprocating motion;

FIG. 6 is a schematic drawing illustrating the production of a net as in a front view with an elongating device according to FIG. 2;

FIG. 7 is a schematic drawing of an embodiment of the Raschel knitting machine in a side view illustrating the position of the surface for positioning a stitch for elongating the stitch;

FIG. 8 is an illustration of an embodiment of the a net according to the present invention, stretched along a direction parallel to the warps in comparison to a net according to the state of the art; and FIG. 9 is an illustration of an embodiment of the a net according to the present invention, stretched along a direction perpendicular to the warps in comparison to a net according to the state of the art.

Figure 3:
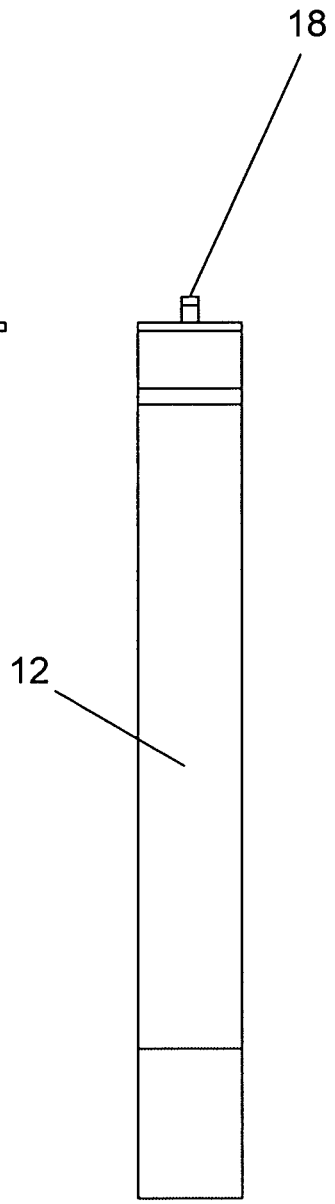
FIG. 3 is a schematic drawing of the embodiment of the elongating device of FIG. 2 in a front view from the left side in FIG. 2.

FIGS. 2 and 3 are schematic drawings of the same embodiment of the elongating device that may be used for elongating the stitch 4 during production of a net comprising elongated stitches. FIG. 2 is a side view and FIG. 3 is a front view from the left side of FIG. 2.

The elongating device of this embodiment comprises a bent and oblong object that is flexible due to its bent form and the material used. The material is a steel. The bent, oblong object is formed by of a first portion 10, a second portion 12 and a third portion 14 between the first portion 10 and the second portion 12 integrally formed by a material stripe. At the junctions of the third portion 14 to the first portion 10 and to the second portion 12 the object is angled, wherein the second portion 12 is bent towards the first portion 10.

The second portion 12 is configured at a loose end that is not connected to the third portion 14 to abut against an abutment element (not shown) by the abutment portion 16. The junction between the second portion 12 and abutment portion 16 may be configured to bend when a force is exercised for example in the first portion 10 towards the third portion 14 such that the abutment portion 16 stays flatly abutted against the abutment element, thereby pressing against the abutment element.

At or close to the junction of the first portion 10 and the third portion 14 a projection 18 is provided on the "upper" surface of the first portion 10, which is the surface that is directed away from the second portion 12.

For a better understanding a single stitch 4 is shown in FIGS. 2 and 3 which is not part of the elongating device. The upper surface of the first portion 10 is the surface for positioning a stitch 4. The stitch 4 is crossing the upper surface. As shown, the projection 18 is formed on the same surface as the surface on which the stitch 4 is positioned and forms a barrier for the stitch 4 if the stitch 4 is moved along the upper surface towards the third portion 14. As shown in FIG. 3, the stitch 4 is hidden behind the projection 18 in the front view. Further, the projection 18 has a width that is smaller than the width of the upper surface 10 and is centrally positioned on the upper surface with respect to the width of the upper surface.

The form of the first portion is not specifically limited to the embodiment as described referring to FIG. 2. The form of the first portion may be adapted to the specific Raschel knitting machine to which the elongating device is attached.

In another embodiment the third portion 14 is not present at all and the second portion is directly connected to the first portion 10. Further, the angles may be rounded.

Figure 4:
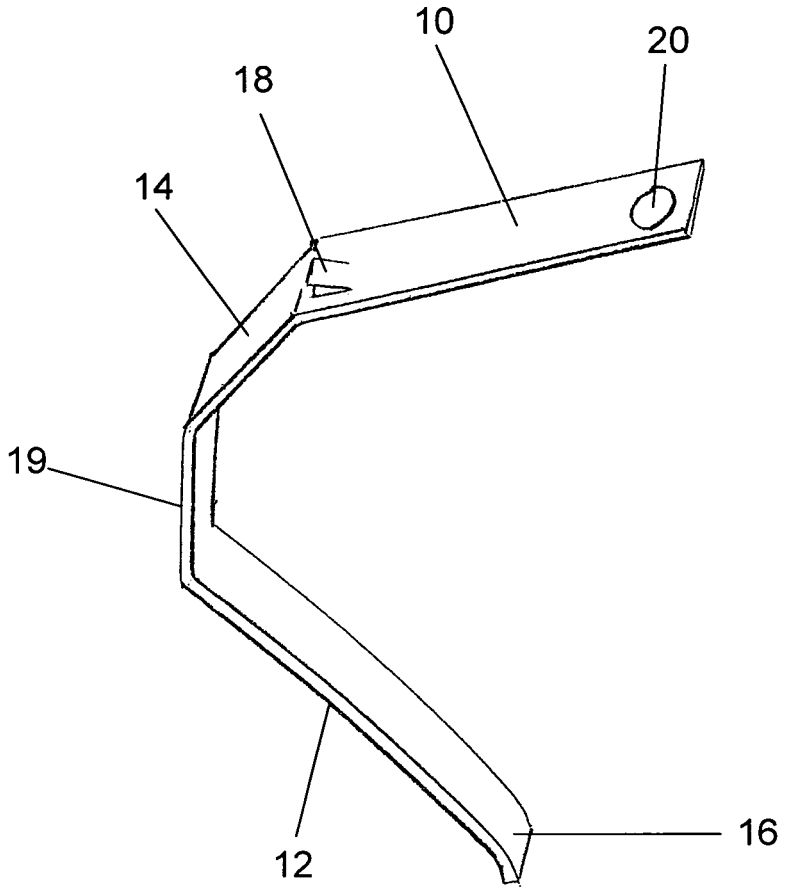
FIG. 4 shows another embodiment of the elongating device in a perspective view.

In FIG. 4 another embodiment of the elongating device is shown in a perspective view. The elongating device comprises a first portion 10, which is provided with a surface for positioning a stitch and a projection 18, a second portion 12, which is provided with an abutment portion 16 for pressing against an abutment element (not shown) and a third portion 14. Between the second portion 12 and the third portion 14 a fourth portion 19 is provided. The junctions of the fourth portions are angled in the same direction as the other junctions.

Further, the projection 18 of this embodiment is integrally formed as a stud that has been blanked out off the first portion 10. The stud forms a projection 18 being a barrier for a stitch positioned on the surface of the first portion 10, thereby preventing the transfer of the stitch towards the second portion 14. The projection 18 is flexible. The projection 18 may be pressed down depending on the force acting on the projection 18. In other words, the projection 18 is a lip or a piece of material that is connected to the first portion 10 by a line junction. Thus, when an adequate force is acting on the surface of the lip, the lip may be pressed down.

Further, as shown in FIG. 4, the embodiment of the elongating device comprises an attachment means 20 for attaching the elongating device to a movement means (not shown). In the embodiment shown in FIG. 4 this attachment means 20 is a hole configured for example for fitting a screw through it.

FIGS. 5*a* and 5*b* are schematic drawings of the embodiment of the elongating device of FIG. 2 in two positions during movement on a bow-like path during production of a net. FIGS. 5*a* and 5*b* are a side view along for example the long axis of a Raschel knitting machine in which the hole needles 22 are arranged. FIG. 6 is a front view corresponding to FIG. 5*b*. Thus, FIGS. 5*a*, 5*b* and 6 illustrate a method for producing the net with elongated stitches according to one embodiment of the invention. The principle of elongating the stitch 4 is illustrated referring to the elongating device that is shown in FIG. 2. However, other embodiments of the elongating device may be used accordingly in the same method.

In FIGS. 5*a*, 5*b*, and 6, a row of loops made of warps 2, wefts 3, and joining points 5 are shown. Further, stitches 4 are shown that are positioned on the surface of the elongating device and other stitches 4 that are not on the surface of the elongating device. The stitches 4 that are positioned around the second portion 12 are loosely positioned around the second portion 12. This is illustrated in FIG. 6 by the three irregular lower stitches 4. The stitches 4 that are positioned on the first portion 10 and the third portion 14 are kept under tension. Accordingly, in FIG. 6 these upper two stitches 4 are illustrated by straight lines following the surface of the object of the elongating device.

Further, hole needles 22 for guiding the weft, hole needles 24 for guiding the warps and needles 26 for creating the loops of the warps 2 are shown. During production of the net, the needles 26 carry out an up and down reciprocating motion, the hole needles 24 make a rotating movement around the needles 26 and the hole needles 22 make a reciprocating translational motion from one needle 26 to another needle 26.

In FIGS. 5*a* and 5*b* the net is extending vertical to the paper plane in the machine direction 7 and in FIG. 6 the net is positioned parallel the paper plane.

The wefts 3 and the warps 2 are connected to material sources (not shown). During production of the net, the net is moved in the machine direction 7 and additional material may be pulled from the material sources. A stitch 4 that is positioned on the first portion 10 or the third portion 14 and that is joined to the loops of two warps 2 is pulled towards the joining points when the net moves in the machine direction 7. Since the stitch 4 is positioned on the surface of the object the stitch 4 may not follow this force and additional material is pulled and the stitch 4 is elongated.

The first portion 10 reaches from one side of the hole needle plane of the hole needles 22 for the wefts to the other side. Thus, a weft 3 that is dragged from one needle 22 to another needle 22 and after forming a stitch 4 when moved in the machine direction 7 the stitch 4 is positioned on the upper surface of the first portion 10.

The first portion 10 of the object of the elongating device is attached to a driving means 21. The driving means comprises a guide bar that is coupled to an element that is configured to swing around an axis parallel to the long axis of the Raschel knitting machine for transmitting a reciprocating motion.

At an end of the object that is not attached to the driving means 21 the second portion 12 presses against an abutment element (not shown). As shown in FIG. 5*a*, the driving means 21 is in a first position and accordingly the elongating device is in a corresponding first position. If the driving means 21 starts the motion, the elongating device follows the movement with the first portion 10 and the third portion 14. The first portion 12 is abutting against an abutment element (not shown) and, therefore, bends. This is shown in FIG. 5*b*. Thus, when the driving means turns from the position as shown in FIG. 5*a* to the position as shown in FIG. 5*b* the object is bent in the moving direction on a bow-like path. This is illustrated in FIGS. 5*a* and 5*b* by the double arrow.

The moving on the bow-like path is carried out at as a reciprocating motion at a frequency of at least 1000 cycles/minute. In other embodiments the moving may be carried out at any machine operating frequency.

During the production of the net and further proceeding of the net in the machine direction 7 and the reciprocating motion a stitch 4 that is positioned on the surface of the first portion 10 moves towards the projection 18 and its way is blocked by the projection 18. The stitch 4 that is now acting on the projection 18 continuous to be elongated as long as the stitch 4 is acting on the projection 18. With increasing length of the stitch the force with witch the stitch 4 is acting on the projection increases. The projection is flexible and when the stitch 4 acts on the projection 18 with an adequate force, the stitch 4 is released.

It is noted that in an alternative embodiment of the method it is not the stitch 4 itself which alone causes the projection to release the stitch, but only when a predetermined number of stitches 4 act on the projection, the projection releases the stitch that was acting first on the projection.

An embodiment of the Raschel knitting machine is shown in FIG. 7 in a side view. The embodiment comprises needles 26 (only one is visible in FIG. 7) and needle bar 28 to which the needles 26 are attached, hole needles 24 (only one is visible in FIG. 7) for the warps and the first guide bar 30 (Comb one) to which the hole needles 24 for the warps are attached, hole needles 22 (only one is visible in FIG. 7) for the wefts and the second guide bar 32 (Comb two) to which the hole needles 22 for the wefts are attached, and a common guide bar 34, i.e. the stitch comb bar, to which the elongating devices are attached. Further, a surface 36 is shown. When the net is produced, it is over this surface that the rows of loops are dragged downwards.

The elongating devices are only illustrated by a line 38, representing the plane in which the surface for positioning the stitch of the elongating device is positioned. Thus, the surface is positioned and attached to the stitch comb bar 34, and below the hole needles 22 for the wefts. Further, the surface extends from the one side of a working plane in which the hole needles 22 for the wefts are positioned to the other side of the working plane.

In an embodiment, in which the elongating device is bent, the elongating device is bent downwards, thus the elongating device is attached to the stitch comb bar 34, reaches through the plane formed by the hole needles 22 for the wefts, is bent downward in a bow like form and abuts against the surface 36. The elongating device is not in a fixed contact to any other part of the Raschel knitting machine between the stitch comb bar 34 and the surface 36 for allowing a free movement according based on the reciprocating movement.

The attaching to the stitch comb bar 34 and the abutting to the surface 36 are configured for a vibrational motion of the elongating device based in a reciprocating motion of the stitch comb bar 36.

Further, it is noted that the needle 26 and the plane in which the surface is positioned may cross each other since the surface is positioned between the needles 26 as illustrated in FIG. 7.

Figure 1:
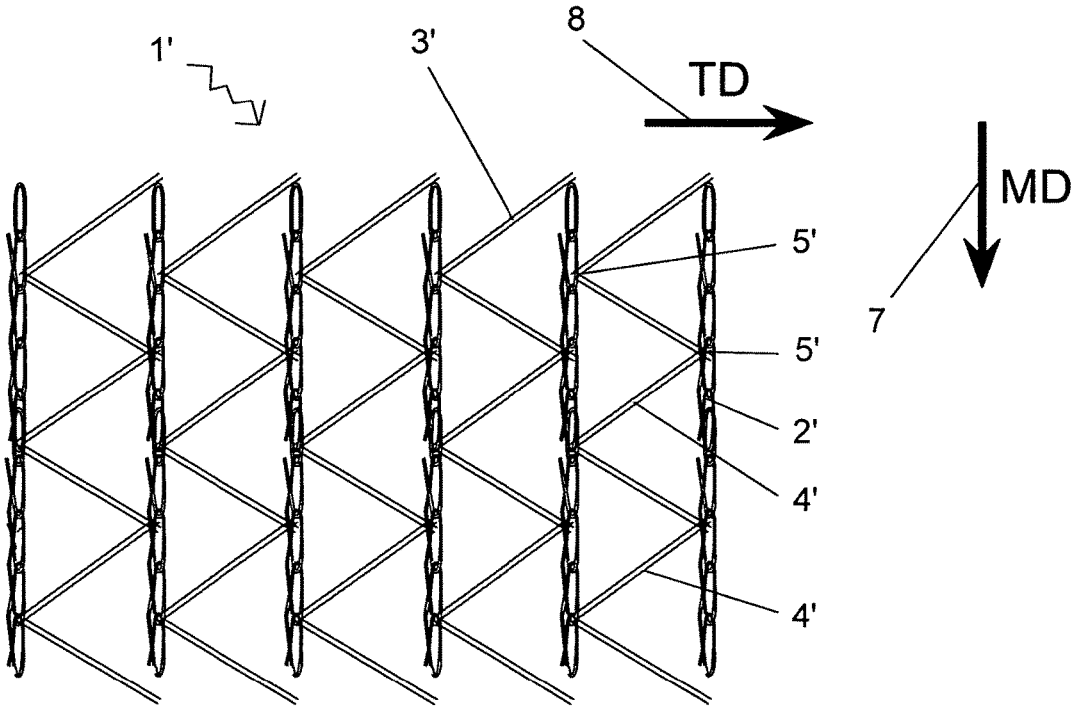

FIGS. 8 and 9 illustrate an embodiment of the net A according to the present invention in comparison to the conventional net B. The reference signs used for the net B carry the mark "'" and correspond to the ones used in FIG. 1.

The net A may be stretched in a direction parallel to the warps 2 as shown in FIG. 8 and perpendicular to the warps 2 as shown in FIG. 9.

Net A and net B comprises a row of loops of the warps 2, 2' and the stitches 4, 4' made of the weft 3, 3'. The row of loops are joined to the weft 3, 3' every 2 loops in a regular zig-zag pattern. Thus, the distance between two joinings 5, 5' of adjacent stitches 4, 4' towards the same adjacent warp 2, 2' is 4 loops.

The length of the stitches 4 of the net A are longer than the stitches 4' of net B.

A conventional net B, for example for the packaging of pallets, has the following characteristics: production width 48 cm, length d of 4 loops equal 57 mm, with elasticity from 15% up to 40%. The stitches 4' of net B are linearly extending. Thus, when the net B is stretched parallel to the rows of loops, the net B narrows very much during stretching.

The stitches 4 of net A are elongated, i.e. at the same distance d the stitches 4 are not linearly extending. Net A has stitches 4 with a length larger than 40-95% of the original stitch 4' of net B (elongating factor 140% to 195%). Consequently, even if the pallet net is stretched more than 100% of the original length, the stitches 4 are still loose and vertical forces are not or at least less applied over the net. Thus no or at least much smaller narrowing is experienced, when the net A is stretched to a length D that is larger than d. This is shown in FIG. 8.

Another important aspect is shown in FIG. 9 in that the net A when the stitches 4 are stretched has a much larger width than net B when the stitches 4' are stretched. Thus, for production of a net having a width of 1230 mm and length of 4 loops equal 57 mm net A may have 52 warps 2' (rows of loops) and net B may have only 48 warps 2 (rows of loops). This is shown in FIG. 9. The distance Z in FIG. 9 is larger than the distance z in FIG. 9.

The invention claimed is:

1. A method for producing a net with an elongated stitch made of a weft, the net formed by at least two warps knitted to at least two rows of loops and by at least one weft joining the at least two warps by at least one stitch, the method comprising:

continuously generating new loops for elongating the at least two rows of loops by additional loops and dragging the at least two rows of loops in a machine direction; and generating a first stitch of the at least one weft by joining the at least one weft to a loop of the first row and to a loop of the second row by joinings, including positioning the first stitch across a surface of an elongating device for preventing the first stitch from travelling with the warps knitted to loops in the machine direction, wherein the joinings are configured for elongating the first stitch by pulling additional weft material and the surface of the elongating device carries out a reciprocating movement, wherein on the surface of the elongating device a projection is provided for preventing the first stitch from moving off the surface, and by dragging the net, the first stitch is moved towards the projection, wherein during the reciprocating movement, the inclination of the surface is modified, and at a specific inclination of the surface, the first stitch is released off the surface over the projection.

2. The method of claim 1, wherein:

the elongating device is positioned between two needles used for knitting the at least two rows of loops and below a hole needle for guiding the at least one weft from one needle to the other needle;

the elongating device is attached at one end to a guide bar for the reciprocating motion; and the elongation device has at another end an abutment portion that presses against an abutment element for a free reciprocating motion between an attaching position where the abutment portion abuts the abutment element and a pressing position where the abutment portion is pressed against the abutment element.

3. The method of claim 1, further comprising:

generating a predetermined number of further stitches of the at least one weft by joining the at least one weft to a loop of the first row and to a loop of the second row;

positioning the predetermined number of further stitches across the surface of the elongating device together with the first stitch; and moving the predetermined number of further stitches towards the projection by dragging the net in the machine direction, wherein the projection is flexible and when the predetermined number of further stitches act on the projection, the first stitch is released.

4. The method of claim 1, further comprising:

positioning the first stitch on a further surface of the elongating device after having left the surface, wherein the further surface is angled with respect to the first surface for keeping the stitch under tension.

5. The method of claim 1, wherein the reciprocating motion corresponds to a path in an arched manner.

6. The method of claim 1, wherein the elongating device comprises:

an oblong, flexible object with a surface and with an abutment portion;

an attachment means for attaching a driving means; and a flexible projection on the surface of the oblong, flexible object.

7. A method for producing a net with an elongated stitch made of a weft, the net formed by at least two warps knitted to at least two rows of loops and by at least one weft joining the at least two warps by at least one stitch, the method comprising:

continuously generating new loops for elongating the at least two rows of loops by additional loops and dragging the at least two rows of loops in a machine direction;

generating a first stitch of the at least one weft by joining the at least one weft to a loop of the first row and to a loop of the second row by joinings, including positioning the first stitch across a first surface of an elongating device for preventing the first stitch from travelling with the warps knitted to loops in the machine direction; and positioning the first stitch on a second surface of the elongating device after having left the first surface, wherein the second surface is angled with respect to the first surface for keeping the stitch under tension, wherein the joinings are configured for elongating the first stitch by pulling additional weft material and the first surface of the elongating device carries out a reciprocating movement.

* * * * *